US011402180B2

(12) United States Patent
Salisbury et al.

(10) Patent No.: US 11,402,180 B2
(45) Date of Patent: Aug. 2, 2022

(54) ACTUATABLE MULTI-BAY CONDUCTED ELECTRICAL WEAPON

(71) Applicant: Axon Enterprise, Inc., Scottsdale, AZ (US)

(72) Inventors: Luke Salisbury, Scottsdale, AZ (US); Patrick W. Smith, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 110 days.

(21) Appl. No.: 17/016,913

(22) Filed: Sep. 10, 2020

(65) Prior Publication Data

US 2021/0071999 A1 Mar. 11, 2021

Related U.S. Application Data

(60) Provisional application No. 62/898,376, filed on Sep. 10, 2019.

(51) Int. Cl.
*F41H 13/00* (2006.01)

(52) U.S. Cl.
CPC ..... *F41H 13/0025* (2013.01); *F41H 13/0012* (2013.01); *F41H 13/0018* (2013.01)

(58) Field of Classification Search
CPC ..... F41H 13/0012; F41H 13/0018; F41H 13/0025
USPC ..... 361/232
See application file for complete search history.

(56) References Cited

U.S. PATENT DOCUMENTS

| | | | | |
|---|---|---|---|---|
| 7,520,081 | B2 | 4/2009 | Kroll | |
| 2014/0233146 | A1* | 8/2014 | Gavin | F41H 13/0025 361/232 |
| 2018/0259303 | A1* | 9/2018 | Nerheim | F41H 13/0025 |
| 2019/0376768 | A1* | 12/2019 | Nerheim | F41H 13/0025 |

* cited by examiner

*Primary Examiner* — Yemane Mehari
(74) *Attorney, Agent, or Firm* — Andrew Terajewicz

(57) ABSTRACT

An actuatable bay conducted electrical weapon comprises a plurality of bays. Each of the bays is configured to releasably receive a deployment unit comprising one or more electrodes. At least one of the bays the plurality of bays is coupled to a body of the conducted electrical weapon via a respective movable member. Each respective movable member is coupled to the body of the conducted electrical weapon by a respective kinematic joint. Responsive to an activation of a control interface, each respective movable member is configured to move about each respective kinematic joint to an expanded position, wherein a distance between each of the bays of the plurality of bays is greater in the expanded position than in a collapsed position. The increased distance is configured to provide a greater initial spread between the one or more electrodes to increase a likelihood of causing NMI in a target.

20 Claims, 4 Drawing Sheets

ACTUATABLE MULTI-BAY CONDUCTED ELECTRICAL WEAPON

FIELD OF THE INVENTION

Embodiments of the present disclosure relate to a conducted electrical weapon comprising one or more actuatable bays.

BRIEF DESCRIPTION OF THE DRAWINGS

To allow for a more complete understanding of the present disclosure, it will now be described by way of example, with reference to the accompanying drawings in which.

Figure 1A:
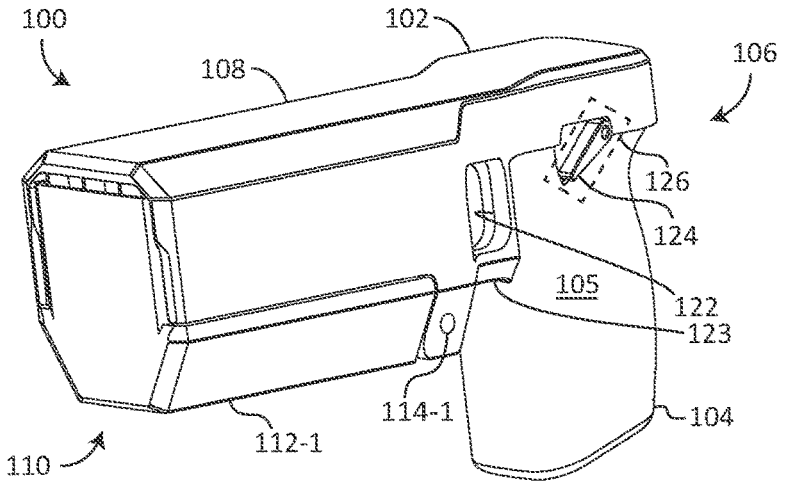
FIG. 1A illustrates a perspective view of an actuatable bay conducted electrical weapon in a collapsed state, in accordance with various embodiments disclosed herein.

Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

DETAILED DESCRIPTION

A conducted electrical weapon ("CEW") may deliver a stimulus signal (e.g., current, pulse, etc.) to a human or animal target to impede locomotion of the target. Locomotion (e.g., running, walking, moving, etc.) may be inhibited by interfering with voluntary use of skeletal muscles and/or causing pain in the target. A stimulus signal that interferes with skeletal muscles may cause the skeletal muscles to lockup (e.g., freeze, tighten, stiffen, etc.), thereby inhibiting voluntary operation of skeletal muscles by the target. Tightening of muscles in response to a stimulus signal may be referred to as neuromuscular incapacitation ("NMI"). NMI temporarily disrupts voluntary control of the skeletal muscles of a target. Because skeletal muscles control the movement of limbs, lockup interferes with voluntary movement of the target. In addition to causing NMI, a stimulus signal may cause pain in a target. Pain in a target may convince the target to stop voluntary locomotion. Causing pain in a target in order to persuade a target to stop moving may also be referred to as pain compliance.

A stimulus signal may be delivered through the target via electrodes coupled to the CEW. The ability of a stimulus signal to lockup the skeletal muscles of a target increases as the distance between the electrodes that deliver the stimulus signal through the target increases. A greater distance between electrodes delivers the stimulus signal through more target tissue, thereby increasing the likelihood of NMI. A spacing (e.g., spread, separation, etc.) of at least 7 inches (18 centimeters) between electrodes enables the stimulus signal to travel through at least 7 inches (18 centimeters) of target tissue, which increases the likelihood of skeletal muscle lockup. Providing a stimulus signal through the target where the electrodes are spaced within a range between 6 inches and 12 inches (15 centimeters and 30 centimeters), preferably 12 inches (30 centimeters), from each other increases a likelihood that the stimulus signal will result in neuromuscular incapacitation.

Providing a stimulus signal through electrodes that are spaced less than 6 inches (15 centimeters) apart on the target, and at times, depending on the location where the electrodes couple to the target, less than 12 inches (30 centimeters) apart, may not cause NMI. Electrodes that are spaced on the target less than 6 inches (15 centimeters) apart, or at times less than 12 inches (30 centimeters) apart, may not provide a stimulus signal through enough target tissue to induce lockup of skeletal muscles. However, even if a stimulus signal does not result in lockup of skeletal muscles, the stimulus signal through target tissue may still cause pain compliance in the target. As a result of the pain, a target may voluntarily decide to limit their movement.

A stimulus signal may be delivered through the target via electrodes directly coupled to the CEW (e.g., terminals). A CEW may include at least two terminals at the front face of the CEW. Terminals may be spaced across the front face of a CEW and may be 2 inches (5 centimeters) apart or less, typically 1 inch (2.5 centimeters). Delivery of a stimulus signal via terminals may be referred to as a local delivery (e.g., a local stun). During local delivery, the terminals are brought close to the target by positioning the front face of the CEW proximate to the target. The stimulus signal is delivered through the target's tissue via the terminals. To provide local delivery, the user of the CEW is generally within arm's reach of the target and brings the terminals of the CEW into contact with or proximate to the target. Because the spacing between terminals on the front face of a CEW may be relatively low (e.g., around 1 inch), local delivery of a stimulus signal typically does not cause NMI in a target. However, local delivery of a stimulus signal may cause intense local pain in a target and may result in pain compliance.

A stimulus signal may be delivered through a target via two or more wire-tethered electrodes (e.g., darts, probes, electrodes, etc.) launched (e.g., deployed, fired, etc.) from a CEW. Wire-tethered electrodes may include a spear (e.g., barb, hook, etc.) for coupling to a target. Delivery via wire-tethered electrodes may be referred to as a remote delivery (e.g., a remote stun). As the wire-tethered electrodes travel toward a target, respective wire tethers (e.g., tethers, filaments, etc.) may deploy behind the electrodes, electrically coupling the electrodes to the CEW. The electrode may electrically couple to the target thereby coupling the CEW to the target. In response to the electrodes connecting with, impacting on, or being positioned proximate to the target's tissue, the stimulus signal may be delivered through the target via the electrodes (e.g., a circuit is formed through a first tether and a first electrode, the target's tissue, and a second tether and a second electrode). In the case of a handheld CEW, a user may hold the handle while operating the CEW, so the range of the CEW during a remote delivery is limited by the length of the wire-tethers from a user to a target. During a remote delivery, the CEW may be separated from the target up to the length of the wire tether (e.g., 5 feet, 10, feet, 15 feet, 25 feet, etc.).

The wire-tethered electrodes may be packaged in individual cartridges (e.g., unitary cartridges). One or more unitary cartridges (e.g., 2, 6, 18, etc.) may be packaged in a deployment unit for deployment by a CEW. A CEW may have one or more bays for receiving deployment units. Each bay of a CEW may releasably engage a deployment unit. Each deployment unit may releasably electrically, electronically, and/or mechanically couple to a bay. A CEW may fire (e.g., deploy, launch, etc.) at least one electrode from each bay toward a target to remotely deliver the stimulus signal through the target via the at least one electrode. Launching an electrode toward a target may be referred to as deploying a unitary cartridge, deploying a deployment unit, and/or deploying a CEW.

A wire-tethered electrode may be propelled from a unitary cartridge via a propulsion system. The propulsion system may comprise a mechanical primer, an electric primer, a solid-propellant, a compressed gas, and combinations thereof. In various embodiments, a propulsion system may be packaged in the unitary cartridge, such that each unitary cartridge has a respective propulsion system. The propulsion system may be activated by the CEW and may provide the force to propel (e.g., launch) the electrode. A unitary cartridge may comprise a single electrode configured to be propelled by a single propulsion system. In various embodiments, the propulsion system may be packaged in the deployment unit for launching the electrode from the unitary cartridge. A propulsion system packaged in the deployment unit may be capable of launching one or more electrodes simultaneously. A propulsion system packaged in a deployment unit may be configured to simultaneously launch one or more electrodes via a manifold within the deployment unit. The manifold within the deployment unit may direct expanding gas from the propulsion system to one or more unitary cartridges, thereby propelling the electrodes from their respective unitary cartridges and from the deployment unit.

Launching the electrodes from the deployment unit via activation of the propulsion system may be referred to as firing (e.g., deploying) a CEW. After some or all of the electrodes have been launched from the unitary cartridges of a deployment unit, the deployment unit may be referred to as spent (e.g., used). A spent deployment unit may be removed from the bay of the CEW and replaced with a new (e.g., unused) deployment unit to permit launch of additional electrodes. A CEW may deploy one or more electrodes from one or more respective deployment units per a single trigger activation.

In various embodiments, a CEW may comprise one or more control interfaces configured to control selection (e.g., activation) of operating modes in a CEW. Controlling selection of operating modes in a CEW may include disabling firing of a CEW (e.g., activating a safety mode or disarmed mode, etc.), enabling firing of a CEW (e.g., activating an armed mode, ready mode, or fire mode, etc.), and/or deploying a CEW. Controlling selection of operating modes in a CEW may include selecting between a collapsed state and an expanded state of the CEW. The one or more control interfaces may include fire mode selector switches, safety switches, safety catches, rotating switches (e.g., rotary switches), selection switches, selective firing mechanisms, and/or any other suitable mechanical control switch. As a further example, a control interface may comprise a touch screen or similar electronic component.

In order to increase the likelihood of skeletal muscle lockup, electrodes may be launched from the CEW such that upon impacting the target, a minimum spread is achieved between the electrodes. The minimum spread may be twelve inches (30 centimeters) as discussed elsewhere herein. A pair of electrodes launched from a same bay of a CEW may have a low initial spread (e.g., 0.5 inches). The low initial spread may correspond to an initial distance between the pair of electrodes in the same bay upon launch from the CEW. In order to achieve the minimum spread when launching electrodes from the same bay, the electrodes may be launched in diverging directions (e.g., trajectories, paths, etc.) such that as the electrodes travel toward a target, the spread between the electrodes increases.

In various embodiments, a deployment unit may be range-specific. A bay of a CEW may interchangeably receive one or more range-specific deployment units, each configured to optimize the likelihood of skeletal muscle lockup over various operating distances. A range-specific deployment unit may house two electrodes configured to launch from the deployment unit via trajectories differing by degrees. A range-specific deployment unit may be configured to achieve a minimum spread over a predetermined range of operating distances.

As an example, a range-specific deployment unit may house two electrodes configured to launch at a relative, differing degree of 12 degrees, such that for every 1 foot (0.3 meters) of travel, the electrodes diverge 2.6 inches (6.6 centimeters). A 12-degree deployment unit may increase the likelihood of skeletal muscle lockup for targets close to the CEW. However, a 12-degree deployment unit may decrease the likelihood of skeletal muscle lockup for targets far from the CEW. For example, deploying two electrodes from a 12-degree deployment unit at a target 4.5 feet (1.3 meters) from the CEW may achieve a 12-inch (0.3 meter) spread. However, deploying two electrodes from a 12-degree deployment unit at a target 15 feet (4.6 meters) from a CEW may result in a 39-inch (1 meter) spread between electrodes, and the electrodes may therefore likely miss the target due to the large distance between electrodes.

As another example, a range-specific deployment unit may house two electrodes configured to launch from the deployment unit via trajectories differing in degrees by 3.5-degrees such that for every 1 foot (0.3 meters) of travel, the electrodes diverge 0.7 inches (1.8 centimeters). A 3.5-degree deployment unit has a lower rate of divergence than a 12-degree deployment unit. A 3.5-degree deployment unit may increase the likelihood of skeletal muscle lockup for targets at a further distance from the CEW as compared with a 12-degree deployment unit. However, a 3.5-degree deployment unit may not be as effective as a 12-degree deployment unit when deployed in close operating distances. For instance, while a 12-degree deployment unit may likely miss a target at 15 feet (4.6 meters) due to a 39 inch (1 meter) spread, at 15 feet (4.6 meters), a 3.5-degree deployment unit may result in a spread of 9 inches (22.9 centimeters), thereby having a greater likelihood of striking the target and causing NMI. Conversely, deploying a 3.5-degree deployment unit at a target 4.5 feet (1.3 meters) from a CEW may result in a spread of only 3.3 inches (8.4 centimeters), which may not provide a stimulus signal through enough target tissue to induce NMI.

In embodiments according to various aspects of the present disclosure, a CEW may have two or more bays, wherein each of the bays is configured to launch an electrode resulting in a large initial spread between the electrodes.

Figure 1B:
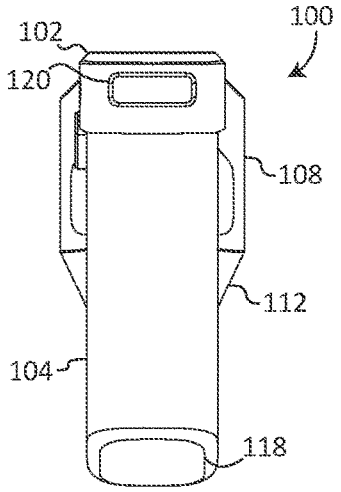
FIG. 1B illustrates a rear view of the actuatable bay conducted electrical weapon of FIG. 1A, in accordance with various embodiments disclosed herein.
Figure 1C:
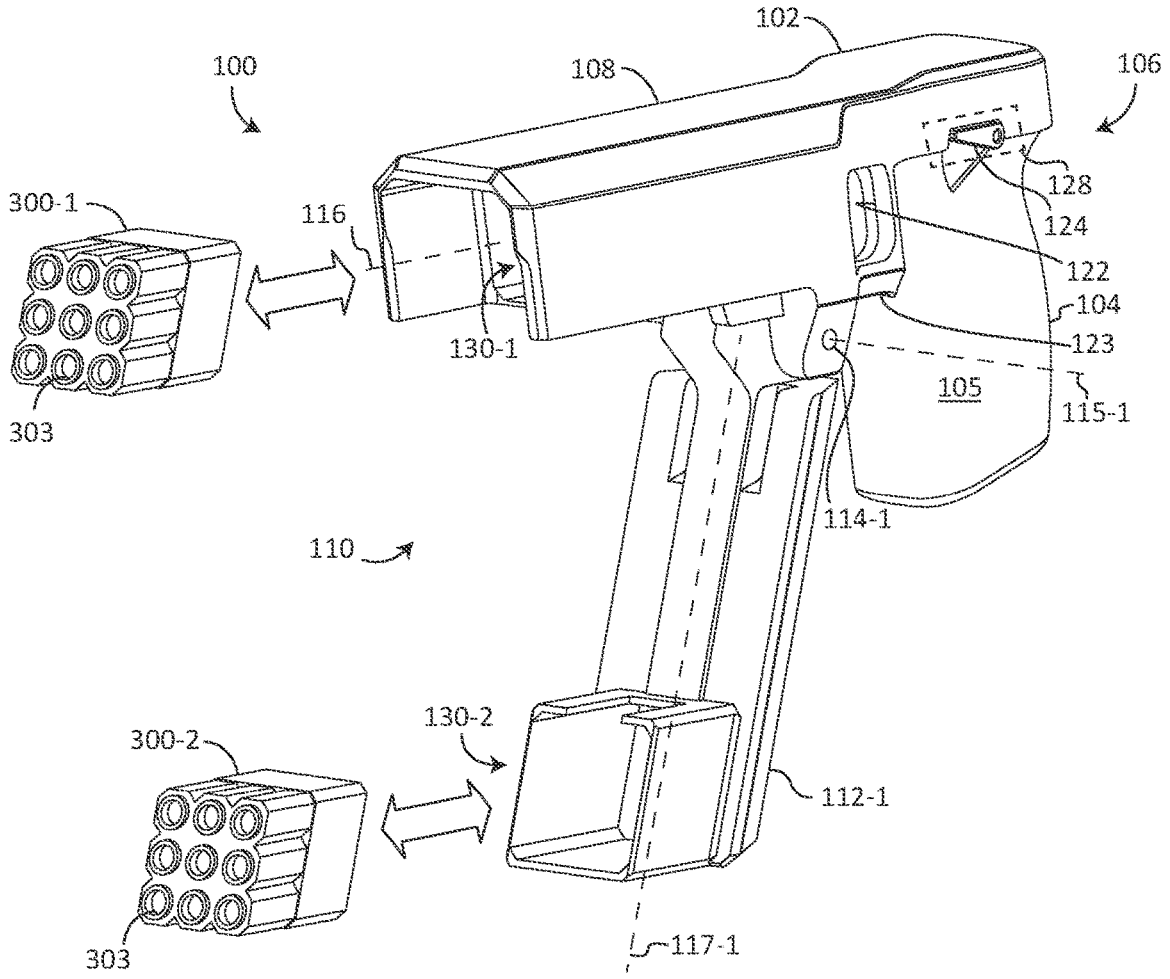
FIG. 1C illustrates a perspective view of the actuatable bay conducted electrical weapon of FIGS. 1A and 1B in an expanded state, in accordance with various embodiments disclosed herein.

In various embodiments, and with reference to FIGS. 1A-1C an actuatable bay CEW 100 is disclosed. CEW 100 may be similar to or have similar aspects or components with, the CEWs previously discussed herein. It should be understood by one skilled in the art that FIGS. 1A-1C are an illustrative representation of CEW 100, and one or more of the components of CEW 100 may be located in any suitable position within, or external to, CEW 100. CEW 100 may comprise a body, such as body 102 and at least one movable member movably coupled to body 102, such as first movable member 112-1. In embodiments, CEW 100 may further comprise one or more control interfaces such as trigger 122 and safety 124.

In various embodiments, body 102 may be configured to house various components of CEW 100 that are configured to enable a deployment unit 300 (e.g., first deployment unit 300-1, second deployment unit 300-2, third deployment unit 300, etc.) to selectively deploy an electrode 305 (with brief reference to FIG. 3B) from a unitary cartridge 303. Although depicted as having a shape of a firearm in FIGS. 1A-1C, body 102 may comprise any suitable shape and/or size. Body 102 may comprise a substantially rigid material such as plastic (e.g., PC/ABS), metal or alloy (e.g., 6061-T6 aluminum, 304 stainless steel, magnesium), carbon fiber, or a combination of substantially rigid materials, wherein substantially rigid materials include materials resistant to deformation and breakage under typical use loads. Typical use loads may include cumulative stresses imparted on body 102 from instances such as, but not limited to, recoil, drop, and thermal shock.

In various embodiments, body 102 may extend between a first end 106 (e.g., rear end) and a second end 110 (e.g., front end) that is opposite first end 106. Body 102 may comprise a handle portion 104 proximate first end 106. Handle portion 104 may be configured to be grasped by a hand of a user. For example, handle portion 104 may be shaped like a handle to enable hand-operation of the CEW by the user. In various embodiments, handle portion 104 may comprise contours shaped to fit the hand of a user. Handle portion 104 may comprise one or more features configured to improve a user's grip on handle portion 104, such as grip 105. Grip 105 may comprise an ergonomic shape. Grip 105 may include one or more features configured to aid a user in gripping handle portion 104, such as, a non-slip surface, a grip pad, and a rubber texture. As a further example, grip 105 may be wrapped in leather, a colored print, or any other suitable material or finish as desired.

In various embodiments, trigger 122 may be configured to move, slide, rotate, or otherwise become physically actuated upon application of physical contact. Trigger 122 may be actuated (e.g., activated) by physical contact applied to trigger 122. Trigger 122 may be disposed within a guard 123. Guard 123 may define an opening formed in body 102. Guard 123 may be located forward of handle portion 104 on a center region of body 102 (e.g., as depicted in FIG. 1), and/or in any other suitable location on body 102. Guard 123 may be configured to protect trigger 122 from accidental activation (e.g., unintentional physical contact).

In various embodiments, trigger 122 may comprise a mechanical or electromechanical switch, button, trigger, or the like. For example, trigger 122 may comprise a switch, a pushbutton, and/or any other suitable type of trigger. In response to an activation of trigger 122, CEW 100 may be configured to deploy one or more electrodes from one or more deployment units.

In various embodiments, safety 124 may be configured to move, slide, rotate, or otherwise become physically actuated upon application of physical contact. Safety 124 may be actuated (e.g., activated) by physical contact applied to safety 124. Safety 124 may comprise any suitable electronic or mechanical component capable of arming and/or disarming CEW 100. Safety 124 may be located in any suitable location on or in body 102. For example, safety 124 may be coupled to an outer surface of body 102. Safety 124 may be coupled to an outer surface of body 102 proximate trigger 122 and/or guard 123. In various embodiments, safety 124 may be physically set to an unarmed, or safe position 126 (with brief reference to FIG. 1A), wherein deployment of CEW 100 may be prevented. Safety 124 may be physically set to an armed position 126 (with brief reference to FIG. 1C), wherein deployment of CEW 100 may be enabled.

In various embodiments, CEW 100 may comprise a plurality of members comprising at least one movable member. Each member may comprise a substantially rigid material as previously discussed herein. Each member of the plurality of members may be configured to receive a unitary cartridge (e.g., via a deployment unit). Each member of the plurality of members may comprise a bay (e.g., opening, cavity, recess, etc.) configured to receive a respective unitary cartridge or deployment unit. Each bay may releasably receive the respective deployment unit. Each bay may be sized, shaped, or otherwise configured to receive a respective deployment unit. Each bay may comprise a connector configured to electrically couple the respective deployment unit to the CEW. Each bay may comprise a mechanical interface configured to releasably engage the respective deployment unit. For example, each bay may comprise a latch, lock, snap, configured to engage and disengage a respective deployment unit.

In various embodiments, at least one member of the plurality of members may be fixed relative to body 102 (e.g., a fixed member). At least one member of the plurality of members may be movable (e.g., translatable, rotatable, translatable and rotatable, etc.) relative to body 102 (e.g., a movable member). A movable member may be coupled (e.g., mechanically linked via a mechanical linkage) to body 102 via a kinematic joint (e.g., joint).

In various embodiments, a kinematic joint may comprise a prismatic joint (e.g., a joint comprising one translational degree of freedom, a sliding joint, a telescoping joint, etc.), a revolute joint (e.g., a rotational joint with one degree of freedom, a pin joint, etc.), or combinations thereof. A kinematic joint may define an axis of movement for a moveable member to move about. For example, a prismatic joint may define an axis of translation for a moveable member to extend about (e.g., along).

In various embodiments, CEW 100 may comprise a fixed member and a movable member, each configured to releasably receive one or more respective unitary cartridges (e.g., via one or more respective deployment units). For example, CEW 100 may comprise a fixed member, such as fixed member 108 (e.g., first member, first fixed member, etc.) and a movable member, such as first movable member 112-1 (e.g., second member, movable member, etc.). Fixed member 108 may be integral with (e.g., formed at the same time as, formed in the same process as, etc.) body 102. First moveable member 112-1 may comprise a unitary member (e.g., formed of the same material, cast, molded, etc.) or first moveable member 112-1 may be formed of multiple parts rigidly coupled together (e.g., welded, fastened, etc.).

In various embodiments, fixed member 108 may extend between first end 106 and second end 110 of body 102. Fixed member 108 may extend along a fixed axis, such as fixed axis 116 (e.g., first axis, first fixed axis, etc.). Fixed axis 116 may be configured to be aligned with an aiming axis defined by aiming sights (e.g., iron sights, reflex sights, red dot sights, reflector sights, etc.) of CEW 100. Fixed member 108 may comprise a first bay 130-1 (e.g., fixed bay, first fixed bay, etc.) proximate second end 110 of body 102 configured to receive a deployment unit, such as first deployment unit 300-1. First bay 130-1 may be configured to receive first deployment unit 300-1 in a front to rear direction (e.g., along fixed axis 116, in a direction between first end 106 and second end 110, etc.). An opening of first bay 130-1 may disposed along fixed axis 116.

In various embodiments, first moveable member 112-1 may extend along a first movable axis 117-1 (e.g., movable axis, second axis, etc.) from a linkage end to a deployment end that is opposite the linkage end. First moveable member 112-1 may be movably coupled with body 102 via a kinematic joint, such as first kinematic joint 114-1. In various embodiments, a length of the first moveable member 112-1 along first movable axis 117-1 between the linkage end and the deployment end may be one or more of greater than one inch (2.5 centimeters), greater than two inches (5.1 centimeters), greater than three inches (7.6 centimeters), greater than four inches (4 centimeters), or greater than five inches (12.7 centimeters). First movable member 112-1 may comprise a second bay 130-2 (e.g., movable bay, first movable bay, etc.) disposed at the deployment end of first moveable member 112-1. Second bay 130-2 may be the same as or share similar aspects to first bay 130-1. Second bay 130-2 may be configured to receive a deployment unit, such as second deployment unit 300-2.

In various embodiments, a joint, such as first kinematic joint 114-1, may mechanically couple the linkage end of first moveable member 112-1 to body 102 of CEW 100. First kinematic joint 114-1 may be the same or have similar aspects and/or components with, the kinematic joints previously discussed herein. First kinematic joint 114-1 may comprise a pin joint (e.g., hinge) rotatable about a first axis 115-1 (e.g., rotational axis, axis of movement, etc.). First axis 115-1 may constrain first moveable member 112-1 to rotation about first axis 115-1. In various embodiments, first kinematic joint 114-1 may comprise a prismatic joint, and rather than rotating about first axis 115-1, first moveable member 112-1 may extend (e.g., telescope) along an axis defined on a plane perpendicular to first axis 115-1.

In various embodiments, CEW 100 may transition from a first state to a second state. The first state may comprise a first physical state and the second state may comprise a second physical state. The second state may be different from the first state. One or more of a relative position, orientation, and dimension of a same element or feature of the CEW may differ between the first state and the second state. For example, and in accordance with various aspects of the present disclosure, FIG. 1A shows a CEW, such as CEW 100, in a collapsed (e.g., closed, compact, contracted, etc.) state, whereas FIG. 1C shows CEW 100 in an expanded (e.g., actuated, activated, etc.) state.

In various embodiments, in a collapsed state, deployment of one or more deployment units may be prevented. In a collapsed state, deployment of all deployment units may be prevented, or deployment of deployment units engaged with bays of movable members may be prevented. A CEW may be configured to deploy only deployment units that are engaged with fixed members in a collapsed state. Deployment of only one deployment unit of a plurality of deployment units may be enabled in a collapsed state.

In various embodiments, in an expanded state, deployment of all deployment units may be enabled. A CEW may be configured to deploy any deployment unit or all deployment units in an expanded state. In an expanded state, a spacing between at least two deployment units may be increased relative to a spacing between the at least two deployment units in a collapsed state. A biasing device (e.g., spring, hydraulic strut, etc.) may be configured to assist CEW 100 in transitioning between an expanded state and a collapsed state.

In various embodiments, a control interface may be configured to control selection between the expanded state and the collapsed state. For example, selection between the expanded state and the collapsed state may be selected in accordance with a position or state of safety 124 or trigger 122.

In order to increase the likelihood of skeletal muscle lockup, electrodes may be launched from the CEW such that upon impacting the target, they achieve a spread of preferably 12 inches (30 centimeters) or greater. In order to achieve a minimum spread (e.g., twelve inches) along a range of distances (e.g. 5 feet, 15 feet, 30 feet, 45 feet, etc.), at least two electrodes may be launched along parallel, or close to parallel, trajectories with a large initial spread (e.g., 6-12 inches) in embodiments according to various aspects of the present disclosure.

In various embodiments, CEW 100 may comprise at least two bays each configured to receive a respective deployment unit. A spread (e.g., distance, measure of separation) between the at least two bays may be adjusted in accordance with a state of CEW 100. For example, in a collapsed state, a spread between the at least two bays may be less than a predetermined distance. In embodiments, the spread may be less than a predetermined distance of six inches (15.2 centimeters), three inches (7.6 centimeters, one inch (2.5 centimeters), or half an inch (1.3 centimeters). Upon transitioning to an expanded state (e.g., from activating trigger 122 or safety 124), the plurality of bays may separate, providing a greater initial spread between electrodes housed in the respective bays.

Launching electrodes with an initial spread of, for instance, 12 inches (30 centimeters) enables electrodes to travel via substantially parallel trajectories toward a target, while still having a likelihood of achieving NMI over a large range of distances. Launching two or more electrodes from a CEW with an initial spread of 6 inches to 12 inches (15 centimeters to 30 centimeters) causes the electrodes to be deployed from bays 6 inches to 12 inches (15 centimeters to 30 centimeters) apart upon launch. Launching electrodes with an initial spread of 12 inches (30 centimeters) in substantially parallel directions establishes a relatively constant 12 inch (30 centimeter) spread between electrodes as electrodes travel toward a target. Electrodes may not diverge from one another as they travel if launched in a substantially parallel direction, thereby increasing an effective range of the weapon.

In the example of FIG. 1A, CEW 100 is shown in a collapsed state. In a collapsed state, first bay 130-1 and second bay 130-2 may be proximate and/or obstructing one another. In a collapsed state, first moveable member 112-1 may be substantially flush and/or parallel with fixed member 108. In a collapsed state, first movable member 112-1 may be in a first collapsed position. In a collapsed state, first movable axis 117-1 may be substantially parallel with fixed axis 116. In a collapsed state, an angle between first movable axis 117-1 and fixed axis 116 may comprise a minimum angle. First bay 130-1 and second bay 130-2 may be aligned along a common axis of a member (e.g., fixed axis 116) in the collapsed state. First bay 130-1 may be enclosed by body 102 and one or more of second bay 130-2 and first moveable member 112-1 in the collapsed state. In a collapsed state, deployment from first bay 130-1 and and/or second bay 130-2 may be mechanically, electrically, and/or electromechanically prevented. For example, in a collapsed state, fixed member 108 may mechanically block (e.g. obstruct, etc.) deployment of electrodes from second bay 130-2 of first movable member 112-1. In a collapsed state, second bay 130-2 may obstruct deployment of electrodes from first bay 130-1 of fixed member 108. In various embodiments, second bay 130-2 may not obstruct first bay 130-1 in a collapsed state, thereby enabling deployment of electrodes from first bay 130-1 in the collapsed state. In a collapsed state, at least one bay may be obstructed and/or at least one bay may be unobstructed and configured for deployment.

In embodiments, a deployment unit may engage different members of a CEW in different directions. The different directions may be defined relative to a respective axis of each different member of the different members. For example, deployment unit 300 may engage fixed member 108 in a first direction along fixed axis 116 but engage first moveable member 112-1 at second direction relative to first moveable axis 117-1. The second direction may comprise an oblique angle relative to first moveable axis 117-1. Such an arrangement may orient electrodes of the deployment in intersecting directions in the collapsed state of CEW 100. Such an arrangement may also decrease an angle by which the different members need to rotate in order to obtain an initial distance in an expanded state of the CEW. In the example of FIG. 1C, CEW 100 is shown in an expanded state. In an expanded state, first bay 130-1 and second bay 130-2 may be positioned distal to one another. In an expanded state, first moveable member 112-1 may be disposed in an expanded position that is different than the collapsed position of first movable member 112-1 in the collapsed state. In an expanded state, first movable axis 117-1 may form an angle with fixed axis 116. In an expanded state, an angle between first movable axis 117-1 and fixed axis 116 may comprise a maximum angle that is greater than the minimum angle.

In various embodiments, in response to an activation of a control interface (e.g., trigger 122, safety 124, etc.) CEW 100 may automatically transition from a collapsed state to an expanded state, or from an expanded state to a collapsed state. Mechanical and/or electromechanical mechanisms may aid in the automatic transition between states. Mechanical and electromechanical mechanisms may include one or more of an actuator (e.g., hydraulic, pneumatic, electric, mechanical, etc.), spring, electromagnet, or other device configured to provide a biasing force. In various embodiments, in response to an activation of the control interface, CEW 100 may automatically transition to a collapsed state. In various embodiments, CEW 100 may require a manual input from the user (e.g., a restorative manual input) to restore CEW 100 to a collapsed state. As an example, a user may manually provide sufficient restoring force to overcome a mechanical mechanism (e.g., hydraulic strut) to collapse CEW 100 from an expanded state to a collapsed state. Alternately or additionally, CEW 100 may require a manual input from the user (e.g., an activating manual input) to dispose CEW 100 in an expanded state. The manual input may dispose CEW 100 in the expanded state independent of (e.g., separately from) any activation of one or more control interfaces of CEW 100.

Figure 2:
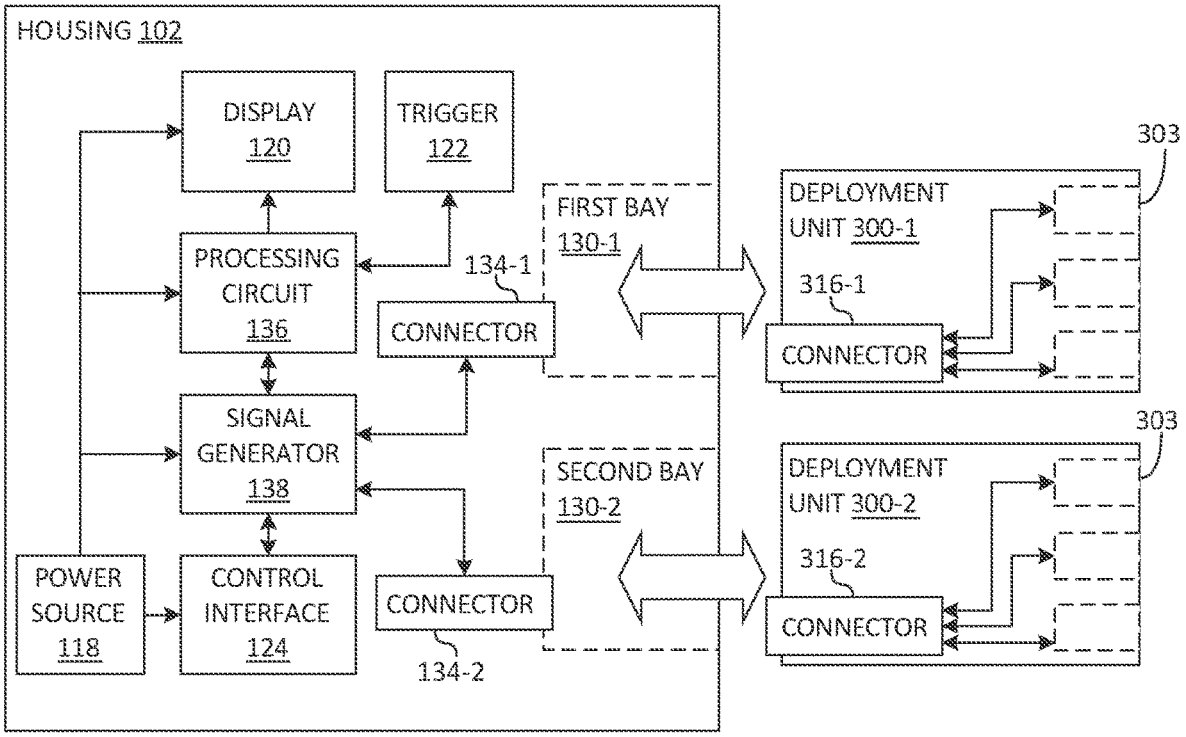
FIG. 2 illustrates a schematic for an actuatable bay conducted electrical weapon, in accordance with various embodiments disclosed herein.

In various embodiments, body 102 may comprise various mechanical, electronic, and electrical components configured to aid in performing the functions of CEW 100. For example, body 102 may comprise one or more displays 120, trigger mechanisms or triggers 122, safeties 124, processing circuits 136, power sources 118, and/or signal generators 138 as shown in FIG. 2.

In various embodiments, trigger 122 may be mechanically and/or electronically coupled to processing circuit 136. In response to trigger 122 being activated (e.g., depressed, pushed, etc. by the user), processing circuit 136 may enable deployment of one or more unitary cartridges 303, as discussed herein. In response to trigger 122 being activated, CEW 100 may be configured to transition from the collapsed state to the expanded state.

In various embodiments, power source 118 may be configured to provide power to various components of CEW 100. For example, power source 118 may provide energy for operating the electronic and/or electrical components (e.g., parts, subsystems, circuits) of CEW 100 and/or one or more unitary cartridges 303. Power source 118 may provide electrical power. Providing electrical power may include providing a current at a voltage. Power source 118 may be electrically coupled to display 120, processing circuit 136 and/or signal generator 138. In various embodiments, in response to safety 124 comprising electronic properties and/or components, power source 118 may be electrically coupled to safety 124. In response to trigger 122 comprising electronic properties or components, power source 118 may be electrically coupled to trigger 122.

In various embodiments, power source 118 may provide an electrical current at a voltage. Electrical power from power source 118 may be provided as a direct current ("DC"). Electrical power from power source 118 may be provided as an alternating current ("AC"). Power source 118 may include a battery. The energy of power source 118 may be renewable or exhaustible, and/or replaceable. For example, power source 118 may comprise one or more rechargeable or disposable batteries. In various embodiments, the energy from power source 118 may be converted from one form (e.g., electrical, magnetic, thermal) to another form to perform the functions of a system.

Power source 118 may provide energy for performing the functions of CEW 100. For example, power source 118 may provide the electrical current to signal generator 138 that is provided through a target to impede locomotion of the target via wire-tethered electrodes. Power source 118 may provide the energy for a stimulus signal. Power source 118 may provide the energy for other signals, including an ignition signal and/or stimulus signal, as discussed herein.

In various embodiments, processing circuit 136 may comprise any circuitry, electrical components, electronic components, software, and/the like configured to perform various operations and functions discussed herein. For example, processing circuit 136 may comprise a processing circuit, a processor, a digital signal processor, a microcontroller, a microprocessor, an application specific integrated circuit (ASIC), a programmable logic device, logic circuitry, state machines, MEMS devices, signal conditioning circuitry, communication circuitry, a computer, a computer-based system, a radio, a network appliance, a data bus, an address bus, and/or any combination thereof. In various embodiments, processing circuit 136 may include passive electronic devices (e.g., resistors, capacitors, inductors, etc.) and/or active electronic devices (e.g., op amps, comparators, analog-to-digital converters, digital-to-analog converters, programmable logic, SRCs, transistors, etc.). In various embodiments, processing circuit 136 may include data buses, output ports, input ports, timers, memory, arithmetic units, and/or the like.

Processing circuit 136 may be configured to provide and/or receive electrical signals whether digital and/or analog in form. Processing circuit 136 may provide and/or receive digital information via a data bus using any protocol. Processing circuit 136 may receive information, manipulate the received information, and provide the manipulated information. Processing circuit 136 may store information and retrieve stored information. Information received, stored, and/or manipulated by processing circuit 136 may be used to perform a function, control a function, and/or to perform an operation or execute a stored program.

Processing circuit 136 may control the operation and/or function of other circuits and/or components of CEW 100. Processing circuit 136 may receive status information regarding the operation of other components, perform calculations with respect to the status information, and provide commands (e.g., instructions) to one or more other components. Processing circuit 136 may command another component to start operation, continue operation, alter operation, suspend operation, cease operation, or the like. Commands and/or status may be communicated between processing circuit 136 and other circuits and/or components via any type of bus (e.g., SPI bus) including any type of data/address bus.

In various embodiments, processing circuit 136 may be electronically coupled to display 120. Display 120 may be an LCD, LED, OLED, AMOLED, or other type of display capable of presenting indicia to a user. Processing circuit may be configured to display user indicia via display 120, such as weapon status, error codes, deployment unit capacity, battery capacity, etc. Display 120 may be electrically and/or electronically coupled to power source 118. Display 120 may receive power from power source 118. The power received by from power source 118 may be used by display 120 to display user indicia, illuminate a backlight, and/or refresh display 120.

In various embodiments, processing circuit 136 may be mechanically and/or electronically coupled to trigger 122. Processing circuit 136 may be configured to detect an activation, actuation, depression, input, etc. (collectively, an "activation event") of trigger 122. In response to detecting the activation event, processing circuit 136 may be configured to perform various operations and/or functions, as discussed further herein. Processing circuit 136 may also include a sensor (e.g., a trigger sensor) attached to trigger 122 and configured to detect an activation event of trigger 122. The sensor may comprise any suitable mechanical and/or electronic sensor capable of detecting an activation event in trigger 122 and reporting the activation event to processing circuit 136.

In various embodiments, processing circuit 136 may be mechanically and/or electronically coupled to safety 124. Processing circuit 136 may be configured to detect an activation, actuation, depression, input, etc. (collectively, a "control event") of safety 124. In response to detecting the control event, processing circuit 136 may be configured to perform various operations and/or functions, as discussed herein. Processing circuit 136 may also include a sensor (e.g., a control sensor) attached to safety 124 and configured to detect a control event of safety 124. The sensor may comprise any suitable mechanical and/or electronic sensor capable of detecting a control event in safety 124 and reporting the control event to processing circuit 136.

In various embodiments, processing circuit 136 may be electrically and/or electronically coupled to power source 118. Processing circuit 136 may receive power from power source 118. The power received from power source 118 may be used by processing circuit 136 to receive signals, process signals, and transmit signals to various other components in CEW 100. Processing circuit 136 may use power from power source 118 to detect an activation event of trigger 122, a control event of safety 124, or the like, and generate one or more control signals in response to the detected events. The control signal may be based on the control event and the activation event. The control signal may be an electrical signal.

In various embodiments, processing circuit 136 may be electrically and/or electronically coupled to signal generator 138. Processing circuit 136 may be configured to transmit or provide control signals to signal generator 138 in response to detecting an activation event of trigger 122. Multiple control signals may be provided from microprocessor 136 to signal generator 138 in series. In response to receiving the control signal, signal generator 138 may be configured to perform various functions and/or operations, as discussed herein.

In various embodiments, safety 124 may be configured to control selection (e.g., activation) of one or more operating modes in CEW 100. Controlling selection of one or more operating modes in CEW 100 may include disabling firing of CEW 100 and enabling firing of CEW 100. Safety 124 may be electrically, mechanically, and/or electronically coupled to processing circuit 136. In various embodiments, in response to safety 124 comprising electronic properties or components, safety 124 may be electrically coupled to power source 118. Safety 124 may receive power (e.g., electrical current) from power source 118 to power the electronic properties or components.

Safety 124 may be electronically or mechanically coupled to trigger 122. For example, and as discussed herein, safety 124 may function as a safety mechanism. In various embodiments, safety 124 may be physically set to an unarmed, or safe position 126, wherein CEW 100 may be prevented from deploying unitary cartridges 303. For example, safety 124 may provide a signal (e.g., a control signal) to processing circuit 136 instructing processing circuit 136 to disable deployment of unitary cartridges 303. As another example, safety 124 may electronically or mechanically prohibit trigger 122 from activating (e.g., prevent or disable a user from depressing trigger 122). As a further example, physically positioning safety 124 in a safe position, such as safe position 126 may cause CEW 100 to transition from an expanded state to a collapsed state, wherein CEW 100 may be unable to deploy unitary cartridges 303.

Safety 124 may further enable selection of a collapsed state and/or an expanded state. The state may be selected in accordance with a position or state of safety 124. In embodiments, an operating mode may be associated with different physical positions on safety 124. The position for an expanded state may be between the positions for a safety mode and an armed mode. For example, safety 124 may comprise a three-position switch (e.g., three-state rocker switch, three-state rotary switch), wherein the expanded state may be selected by positioning the switch to the middle state (e.g., second position). In response to selecting the expanded state, first moveable member 112-1 may rotate about first kinematic joint 114-1 such that an angle between fixed axis 116 and first movable axis 117-1 increases and/or such that a distance between first bay 130-1 and second bay 130-2 increases. In response to selecting an armed mode (e.g., third position), CEW 100 may be armed and ready to fire from the expanded state. In response to activating the safety mode (e.g., first position), CEW 100 may transition to the collapsed state and/or be unarmed as discussed further herein.

In various embodiments, the expanded state may be selected via a second control interface, which may be located in any suitable location on or in body 102. For example, a second control interface may be coupled to an outer surface of house 102. A second control interface may be coupled to an outer surface of body 102 proximate trigger 122 and/or guard 123. The second control interface may be electrically, mechanically, and or electronically coupled to processing circuit 136. The second control interface may comprise any suitable electronic or mechanical component capable of enabling selection of an expansion mode in CEW 100. For example, a second control interface may comprise, a rocker switch, a rotary switch, a push-button switch, a toggle switch, or any other suitable mechanical control switch. As a further example, a second control interface may comprise a touch screen or similar electronic component.

In various embodiments, the second control interface may enable exclusive toggling of the expanded state in CEW 100, while safety 124 may allow selection of the safety mode and the armed mode. As an example, the second control interface may have two positions, a first position enabling activation of the expanded state of CEW 100 and a second position enabling activation of the collapsed state of CEW 100. As another example, the second control interface may be a toggle switch, such that with an activation of the toggle switch, CEW 100 toggles between the collapsed state and the expanded state.

In various embodiments, a signal generator 138 may be configured to receive one or more control signals from processing circuit 136. Signal generator 138 may provide an ignition signal to deployment units 300 based on the control signals. Signal generator 138 may be electrically and/or electronically coupled to processor 136 and/or a deployment unit. Deployment unit 300 may be electrically and/or electronically coupled to respective unitary cartridges 303, such that signal generator 138 may provide an ignition signal to unitary cartridges 303.

In various embodiments, signal generator 138 may be electrically coupled to power source 118. Signal generator 138 may use power received from power source 118 to generate an ignition signal. For example, signal generator 138 may receive an electrical signal from power source 118 that has first current and voltage values. Signal generator 138 may transform the electrical signal into an ignition signal having second current and voltage values. The transformed second current and/or the transformed second voltage values may be different from the first current and/or voltage values. The transformed second current and/or the transformed second voltage values may be the same as the first current and/or voltage values. Signal generator 138 may temporarily store power from power source 118 and rely on the stored power entirely or in part to provide the ignition signal. Signal generator 138 may also rely on received power from power source 118 entirely or in part to provide the ignition signal, without needing to temporarily store power.

In various embodiments, signal generator 138 and processing circuit 136 may be separate components (e.g., physically distinct, logically discrete). Signal generator 138 may be controlled entirely or in part by processing circuit 136. Signal generator 138 and processing circuit 136 may be a single component. For example, a control circuit within body 102 may at least include signal generator 138 and processing circuit 136. The control circuit may also include other components and/or arrangements, including those that further integrate corresponding function of these elements into a single component or circuit, as well as those that further separate certain functions into separate components or circuits.

In various embodiments, signal generator 138 may be controlled by the control signals to generate an ignition signal having a predetermined current value or values. For example, signal generator 138 may include a current source. The control signal may be received by signal generator 138 to activate the current source at a current value of the current source. An additional control signal may be received to decrease a current of the current source. For example, signal generator 138 may include a pulse width modification circuit coupled between a current source and an output of the control circuit. A second control signal may be received by signal generator 138 to activate the pulse width modification circuit, thereby decreasing a non-zero period of a signal generated by the current source and an overall current of an ignition signal subsequently output by the control circuit. The pulse width modification circuit may be separate from a circuit of the current source or, alternatively, integrated within a circuit of the current source. Various other forms of signal generators 138 may alternatively or additionally be employed, including those that apply a voltage over one or more different resistances to generate signals with different currents.

Responsive to receipt of a signal indicating activation of trigger 122 (e.g., an activation event), a control circuit may provide one or more ignition signals and/or stimulus signals to one or more deployment units 300. For example, signal generator 138 may provide an electrical signal as an ignition signal to one or more deployment units, such as first deployment unit 300-1 and second deployment unit 300-2 in response to receiving a control signal from processing circuit 136. Signal generator 138 may provide a signal to first deployment unit 300-1 in first bay 130-1 via first handle connector 134-1 in handle 102 and first deployment connector 316-1 in first deployment unit 300-1. Signal generator 138 may provide a signal to second deployment unit 300-2 in second bay 130-2 via second handle connector 134-2 in handle 102 and second deployment connector 316-2 in second deployment unit 300-2. Deployment units 300-1/300-2 may further transmit the signal to one or more unitary cartridges 303. In various embodiments, a second, separate signal generator, component, or circuit within body 102 may be configured to generate the stimulus signal. Signal generator 138 may also provide a ground signal path for unitary cartridge 303, thereby completing a circuit for an electrical signal provided to unitary cartridge 303 by signal generator 138. The ground signal path may also be provided to unitary cartridge 303 by other elements in body 102, including power source 118.

In various embodiments, a propulsion system may be coupled to, or in communication with each electrode 305. In various embodiments, deployment units 300-1/300-2 may comprise a plurality of propulsion systems in which each propulsion system is coupled to, or in communication with, one or more electrodes 305. A propulsion system may comprise any device, propellant (e.g., air, gas, etc.), primer, or the like capable of providing a propulsion force in unitary cartridge 303. The propulsion force may include an increase in pressure caused by rapidly expanding gas within an area or chamber. The propulsion force may be applied to electrodes 305 in unitary cartridges 303 to cause the deployment of electrodes 305. The propulsion system may provide the propulsion force in response to unitary cartridge 303 or deployment unit 300 receiving the ignition signal.

In various embodiments, the propulsion force may be directly applied to one or more electrodes 305. The propulsion system may be in fluid communication with electrodes 305 to provide the propulsion force. For example, the propulsion force from a propulsion system may travel within a body, channel, or manifold of deployment unit 300 or unitary cartridge 303, to one or more electrodes 305.

A CEW may interchangeably receive a plurality of deployment units 300, such as first deployment unit 300-1, second deployment unit 300-2, and third deployment unit 300-3. First deployment unit 300-1, second deployment unit 300-2, and third deployment unit 300-3 may be the same, or be interchangeable. Each deployment unit 300 may hold a plurality of unitary cartridges 303. For instance, deployment unit 300 may hold at least two unitary cartridges 303, or in some instances, deployment unit 300 may hold as many as 9 or more unitary cartridges 303. Deployment unit 300 may be interchangeably received by the body or body of the weapon system via two or more bays (e.g., first bay 130-1 and second bay 130-2). Each bay may be configured to releasably couple with deployment unit 300. Each deployment unit 300 may house one or more unitary cartridges, such as unitary cartridge 303. CEW 100 may be able to detect which deployment unit is installed such that it can determine the operation of the weapon. For instance, some deployment units may configure the weapon to launch a single electrode 305 with a single activation of trigger 122, while other deployment units may be configured to fire one or more electrodes 305 with a single user input.

In various embodiments, deployment unit 300 may comprise a plurality of unitary cartridges 303. Deployment unit 300 may comprise any suitable or desired number of unitary cartridges 303, such as, for example, two, three, nine, twelve, eighteen, and/or any other desired number of unitary cartridges 303. Further, body 102 may be configured to receive any suitable or desired number of deployment units 300 greater than or equal to two, such as, for example, two deployment units, three deployment units (as discussed below) or more, each corresponding with a bay of the CEW.

Deployment unit 300 may include a plurality of unitary cartridges 303, where each unitary cartridge 303 is configured to launch at least one electrode 305 electrically coupled to deployment unit 300 via a wire-tether. Deployment unit 300 may be configured to launch one or more electrodes 305 housed in each unitary cartridge 303. Deployment unit 300 may engage first bay 130-1 and/or second bay 130-2 by sliding in a substantially front-to-rear direction (e.g., in a direction from the second end 110 towards the first end 106). Deployment unit 300 and may be retained in first bay 130-1 and/or second bay 130-2 via releasable mechanisms. Releasable mechanisms may include a mechanical latch (e.g., snap-lock), magnetic latch, etc.

Deployment unit 300 may include a top surface 304, a bottom surface 306 opposite top surface 304, a rear surface 308 extending between top surface 304 and bottom surface 306, a front surface 310 extending between top surface 304 and bottom surface 306, wherein the front surface 310 may include a plurality of firing tubes 302. A first side surface 312 may extend from top surface 304 and bottom surface 306 between front and rear surfaces 310, 308, and a second side surface 314 may extend from top surface 304 and bottom surface 306 between front and rear surfaces 310, 308 opposite first side surface 312.

Figure 3A:
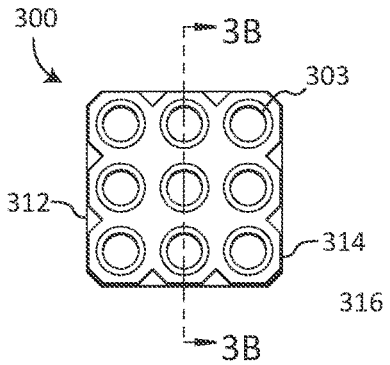
FIG. 3A illustrates a front view of a deployment unit for an actuatable bay conducted electrical weapon, in accordance with various embodiments disclosed herein.
Figure 3B:
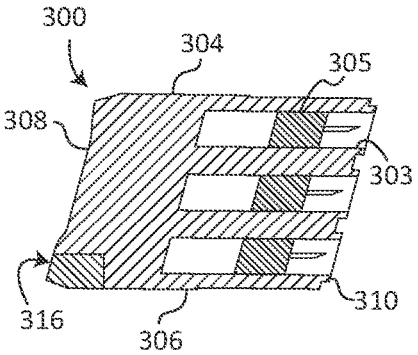
FIG. 3B illustrates a cross section view of the deployment unit of FIG. 3A along plane 3B-3B, in accordance with various embodiments disclosed herein.

While the exemplary deployment unit 300 illustrated in FIGS. 3A-3C shows nine unitary cartridges 303, the number of unitary cartridges may have any number, such as 4 or 18 unitary cartridges. Each unitary cartridge 303 may be configured to independently launch a respective electrode 305. The orientation of unitary cartridges 303 may determine a direction of flight (e.g., trajectory) of the electrode. Unitary cartridges 303 may be grouped as a pattern such as an array comprising a plurality of rows and columns when looking at front surface 310 of the deployment unit 300. Unitary cartridges 303 may also be grouped as a pattern such as an array comprising a plurality of concentric circles when looking at front surface 310 of deployment unit 300. Unitary cartridges 303 may be grouped in a pattern such as to maximize the number of unitary cartridges 303 on front surface 210.

As shown in FIG. 3A, deployment unit 300 comprises nine unitary cartridges 303 grouped together in an array having three rows and three columns (3×3 array). Each unitary cartridge 303 may be configured to be oriented substantially parallel with one another and along a same direction. For example, when deployment unit 300 is inserted into first bay 130-1 of CEW 100, unitary cartridges 303 may be substantially parallel with fixed axis 116 of fixed member 108.

Deployment unit 300 may further comprise a deployment connector 316 electrically coupled to unitary cartridges 303. Deployment connector 316 may be positioned on rear surface 308 such that when deployment unit 300 is inserted into body 102, deployment connector 316 electrically couples with handle connector 134 of body 102 (e.g., first handle connector 134-1, second handle connector 134-2).

In various embodiments, arming CEW 100 by rotating safety switch 124 from unarmed position 126 to armed position 128 allows actuation of trigger 122 to launch electrodes 305 from deployment unit 300. Upon switching safety switch 124 to armed position 128, first moveable member 112-1 may rotate about first kinematic joint 114-1 to an expanded state as shown in FIGS. 1C and 4A-D.

In various embodiments, safety 124 may electrically arm/disarm CEW 100 without causing actuation of first moveable member 112-1. Rather, CEW 100 may further comprise a second control interface (e.g., button, switch, lever), which independently actuates first moveable member 112-1 upon an activation. An interface independent of safety 124 may improve safety when handling and loading CEW 100. CEW 100 further comprising a second control interface which independently actuates first moveable member 112-1 while safety 124 is in unarmed position 126 may allow CEW 100 to be handled in an expanded state without the risk of accidentally deploying (e.g., negligently discharging) CEW 100.

In various embodiments, safety 124 may have three positions including a first disarmed-collapsed position, a second disarmed-expanded position, and a third armed-expanded position. In the first disarmed-collapsed position, CEW 100 may be in a collapsed state, and electrically incapable of launching electrodes, however other electrical systems may be operational such as LED illuminators, laser spot indicators, and/or display 120. In the second disarmed-expanded position, CEW 100 may be in an expanded state and electrically incapable of launching electrodes. A second disarmed-expanded position of safety 124 may allow CEW 100 to be safely loaded while first bay 130-1 and second bay 130-2 are exposed, without concern of accidentally deploying electrodes form CEW 100. In the third armed-expanded state, CEW 100 may be in an expanded state and ready to launch electrodes from deployment units 300.

FIGS. 4A-4D show various embodiments of actuatable bay CEWs in expanded states, such as CEW 400*a*, CEW 400*b*, CEW 400*c*, and CEW 400*d*, which may be similar to, or share similar aspects or components with the CEWs previously described herein. One or more elements or features of CEWs 400*a/b/c/d* may correspond to one or more elements of CEW 100. For the CEWs illustrated in FIGS. 4A-4D, corresponding elements or features are referred to using similar reference numerals under the "4xx*a*", "4xx*b*", "4xx*c*", and "4xx*d*" series of reference numerals, rather than the "1xx" series of references numerals as used in the embodiments of FIGS. 1-2.

In various embodiments, a CEW 400*a* may comprise a body 402*a* extending between a first end 406*a* and a second end 410*a* opposite first end 406*a*. CEW 400*a* may comprise a handle portion 404*a* that is disposed proximate first end 406*a*. CEW 400*a* may comprise one or more control interfaces, such as trigger 422*a* and safety 424*a*. Safety 424*a* may be disposed proximate handle portion 404*a*. Trigger 422*a* may be disposed proximate handle portion 404*a*. CEW 400*a* may comprise a fixed member 408*a* extending along a fixed axis 416*a* between first end 406*a* and second end 410*a*. Fixed member 408*a* may comprise a first bay 430-1*a* disposed proximate second end 410*a*. First bay 430-1*a* may be configured to receive a deployment unit (e.g., first deployment unit 300-1) comprising one or more electrodes (e.g., electrodes 305). CEW 400*a* may comprise a first moveable member 412-1*a* extending along a first movable axis 417-1*a* between a linkage end and a deployment end opposite the linkage end. First moveable member 412-1*a* may be movably coupled to body 402*a* via a first kinematic joint 414-1*a* at the linkage end. A second bay 430-2*a* configured to receive a deployment unit (e.g., second deployment unit 300-2) may be disposed at the deployment end of first moveable member 412-1*a*.

Upon activation of a control interface, such as trigger 422*a* or control interface 424*a*, first moveable member 412-1*a* may rotate about first kinematic joint 414-1*a* to form an angle T1 between fixed axis 416*a* of fixed member 408*a* and first movable axis 417-1*a*. In various embodiments, T1 may be between 30 and 45 degrees, between 45 and 60 degrees, between 60 and 75 degrees, between 75 and 90 degrees, between 30 and 90 degrees, or less than 90 degrees. In the expanded state, first movable member 412-1*a* and fixed member 408*a* may be nonparallel. In the expanded state, first movable member 412-1*a* and fixed member 408*a* may form an acute angle. In the expanded state, first bay 430-1*a* may be positioned relative to second bay 430-2*a* such that electrodes launched from first bay 430-1*a* and electrodes launched from second bay 430-2*a* are launched on substantially parallel trajectories. For example, a launch angle between the launch trajectories of electrodes deployed from first bay 430-1*a* and second bay 430-2*a*, such as launch angle A1, may be zero.

In embodiments, angle T1 may be defined relative to an aiming axis. A zero degree angle may be defined along the aiming axis. The zero degree angle may be defined along the aiming axis in a direction in which an electrode may be deployed from a CEW. The zero degree angle may be defined along the aiming axis in a direction away from a handle portion of the CEW. For example, and with brief reference to FIG. 4A, aiming axis of CEW 400*a* may comprise fixed axis 416*a*. A zero degree angle for CEW may be defined along fixed axis 416*a* in a direction toward second end 410*a* from first end 406*a*. One or more electrodes may be deployed from CEW 400*a* in a direction along fixed axis 416*a* away from handle portion 404*a*.

In embodiments, angle T1 may be defined in a vertical plane of CEW 400*a*. The vertical plane may intersect second end 410*a* of CEW 400*a* along fixed axis 416*a* and one or more of handle portion 404*a* and a power source of CEW 400 (e.g., power source 118 with brief reference to FIG. 1B). The vertical plane may be parallel to a direction in which handle portion 404*a* extends away from fixed axis 416*a*. The vertical plane may intersect first bay 430-1*a* and second bay 430-2*a*. The vertical plane may intersect fixed member 408*a* and first movable member 412-1*a*. Such an arrangement may enable first moveable member 412-1*a* to be aided by the force of gravity when CEW 400*a* transitions from a collapsed state to the expanded state illustrated in FIG. 4A. Such an arrangement may enable first bay 430-1*a* and second bay 430-2*a* to be vertically separated in the expanded state.

In the expanded state, a distance between first bay 430-1*a* and second bay 430-2*a* may comprise an initial spread, such as initial spread D1. Initial spread D1 may be between three inches and six inches (7.6 centimeters and 15.2 centimeters), between six inches and nine inches (7.6 centimeters and 22.9 centimeters), between nine inches and twelve inches (22.9 centimeters and 30.5 centimeters), between three inches and twelve inches (7.6 centimeters and 30.5 centimeters), or any other suitable distance according to various embodiments disclosed herein. Initial spread D1 may be greater than another distance between first bay 430-1*a* and second bay 430-2*a* in a contracted state (not shown). The other distance may be zero inches, less than one inch, or less than two inches in embodiments according to various aspects of the present disclosure. Initial spread D1 in conjunction with launch angle A1 may control the launch trajectories and spread of electrodes from first bay 430-1*a* and second bay 430-2*a* to improve the likelihood of causing NMI in a target. Upon firing CEW 400*a* in an expanded state, at least one electrode may be launched from first bay 430-1*a*, and at least one electrode may be launched from second bay 430-2*a*, such that at least two electrodes may impact a target with a spread likely to cause NMI. Electrodes launched from first bay 430-1*a* and second bay 430-2*a* may maintain a relatively constant spread as they travel toward a target and impact the target with a spread close to D1. In an embodiment where D1 is eight inches (20.3 centimeters) and A1 is zero degrees, electrodes launched from first bay 430-1*a* and second bay 430-2*a* may maintain a relatively constant spread of eight inches as they travel toward a target, thereby increasing the likelihood of causing NMI in a target upon impact. In various embodiments, D1, A1, and T1 may be modified to optimize size and ergonomics of CEW 400*a*. D1, A1, and T1 may modified to optimize efficacy of CEW 400*a* in causing NMI in a target over various operating distances.

In various embodiments, CEW 400*b* may comprise a body 402*b* extending between a first end 406*b* and a second end 410*b* opposite first end 406*b*. CEW 400*b* may comprise a handle portion 404*b* that is disposed proximate first end 406*b*. CEW 400*b* may comprise one or more control interfaces, such as trigger 422*b* and safety 424*b*. Safety 424*b* may be disposed proximate handle portion 404*b*. Trigger 422*b* may be disposed proximate handle portion 404*b*. CEW 400*b* may comprise a fixed member 408*b* extending along a fixed axis 416*b* between first end 406*b* and second end 410*b*. Fixed member 408*b* may comprise a first bay 430-1*b* disposed proximate second end 410*b*. First bay 430-1*b* may be configured to receive a deployment unit such as first deployment unit 300-1. CEW 400*b* may comprise a first moveable member 412-1*b* extending along a first movable axis 417-1*b* between a linkage end and a deployment end opposite the linkage end. First moveable member 412-1*b* may be movably coupled to body 402*b* via a first kinematic joint 414-1*b* at the linkage end. A second bay 430-2*b* configured to receive a deployment unit, such as second deployment unit 300-2, may be disposed at the deployment end of first moveable member 412-1*b*.

Upon activation of a control interface, such as trigger 422*b* or safety 424*b*, first moveable member 412-1*b* may rotate about first kinematic joint 414-1*b* to form an angle T2 between fixed axis 416*b* and first movable axis 417-1. In various embodiments, T2 may be between 30 and 45 degrees, between 45 and 60 degrees, between 60 and 75 degrees, between 75 and 90 degrees, between 30 and 90 degrees, or less than 90 degrees. In the expanded state, first bay 430-1*b* may be positioned relative to second bay 430-2*b* such that electrodes launched from first bay 430-1*b* and electrodes launched from second bay 430-2*b* are launched on diverging trajectories. For example, a launch angle between the launch trajectories of electrodes deployed from first bay 430-1*b* and second bay 430-2*b*, such as launch angle A2, may be between 0.5 degrees and 0.75 degrees, between 0.75 degrees and 1 degree, between 1 degree and 1.25 degrees, between 1.25 degrees and 1.5 degrees, between 1.5 degrees and 3 degrees, between 0.5 degrees and 3 degrees, less than 1 degree, less than 2 degrees, or less than 3 degrees.

In the expanded state, a distance between first bay 430-1*b* and second bay 430-2*b* may comprise an initial spread, such as initial spread D2. Initial spread D2 may be between three inches and six inches (7.6 centimeters and 15.2 centimeters), between six inches and nine inches (7.6 centimeters and 22.9 centimeters), between nine inches and twelve inches (22.9 centimeters and 30.5 centimeters), between three inches and twelve inches (7.6 centimeters and 30.5 centimeters), or any other suitable distance according to various embodiments disclosed herein. Initial spread D2 in conjunction with launch angle A2 may control the launch trajectories and spread of electrodes from first bay 430-*b* and second bay 430-2*b* to improve the likelihood of causing NMI in a target. Upon firing CEW 400*b* in an expanded state, at least one electrode may be launched from first bay 430-1*b*, and at least one electrode may be launched from second bay 430-2*b*, such that at least two electrodes may impact a target with a spread likely to cause NMI. For example, in an embodiment where D2 is eight inches (20.3 centimeters) and A1 is one degree, electrodes launched from first bay 430-1*b* and second bay 430-2*b* may diverge as they travel toward a target and impact the target with a spread greater than twelve inches, depending on a distance to the target, thereby increasing a likelihood of causing NMI in a target. In various embodiments, D2, A2, and T2 may be modified to optimize size and ergonomics of CEW 400*b*. D2, A2, and T2 may modified to optimize efficacy of CEW 400*b* in causing NMI in a target over various operating distances.

In various embodiments, D2 may be less than D1, and A2 may be greater than A1, providing a footprint CEW 400*b* that is smaller than a footprint of CEW 400*a*. In CEW 400*b* of FIG. 4B for example, D2 may be for example seven inches (17.8 centimeters), and A2 may be 1.5-degrees. In such a configuration, electrodes may be launched from first bay 430-1*b* and second bay 430-2*b* with an initial spread of seven inches and a divergence rate of 0.31 inches/foot of travel (0.79 centimeters/30.5 centimeters of travel), meaning that for every foot traveled, the spread between electrodes launched from first bay 430-1*b* and second bay 430-2*b* will increase 0.31 inches (0.79 centimeters). A2 and D2 may be modified to affect the effective range of CEW 400*b* and the ergonomics and handling of CEW 400*b*. For instance, as D2 decreases, the volume occupied by CEW 400*b* may decrease. In various embodiments as D2 decreases, A2 may increase to compensate for the reduced initial spread of CEW 400*b* in the expanded state.

In various embodiments, in an expanded state, deployment units in first bay 430-1*b* and second bay 430-2*b* may be separated by a predetermined distance (e.g., D2) and aimed along non-parallel trajectories (e.g., A2). The predetermined distance may be modified by modifying a length of first moveable member 412-1*b*. A length of first moveable member 412-1*b* may be less than a length of fixed member 408*b*, such that in a collapsed state, second bay 430-2*b* of moveable member 412*b* may be positioned rearward of first bay 430-1*b* and closer to first end 406*b*. In such a configuration in which a second bay does not obstruct a first bay in a collapsed state, the CEW may enable deployment of the deployment unit in the first bay in the collapsed state.

In various embodiments, an actuatable bay CEW may comprise more than one moveable member. For example, an actuatable bay CEW may comprise two movable members, three movable members, or more than three movable members.

Figure 4A:
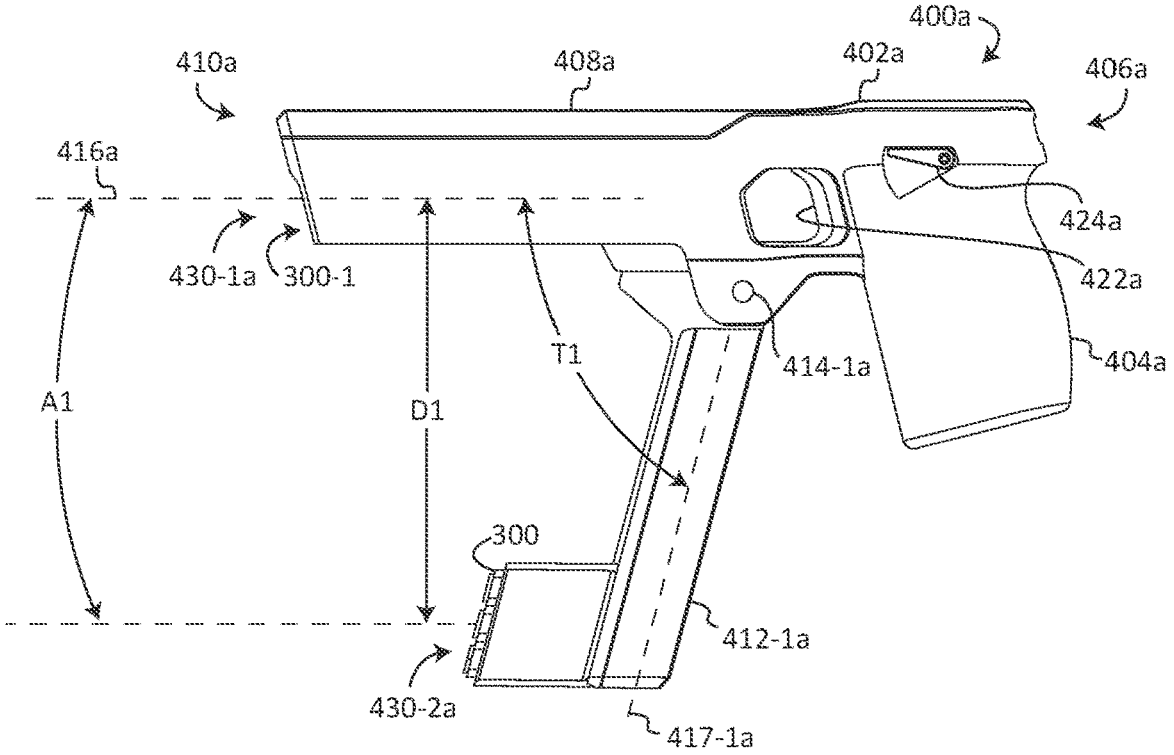
FIG. 4A illustrates an implementation of an actuatable bay conducted electrical weapon in an expanded state, in accordance with various embodiments disclosed herein.
Figure 4B:
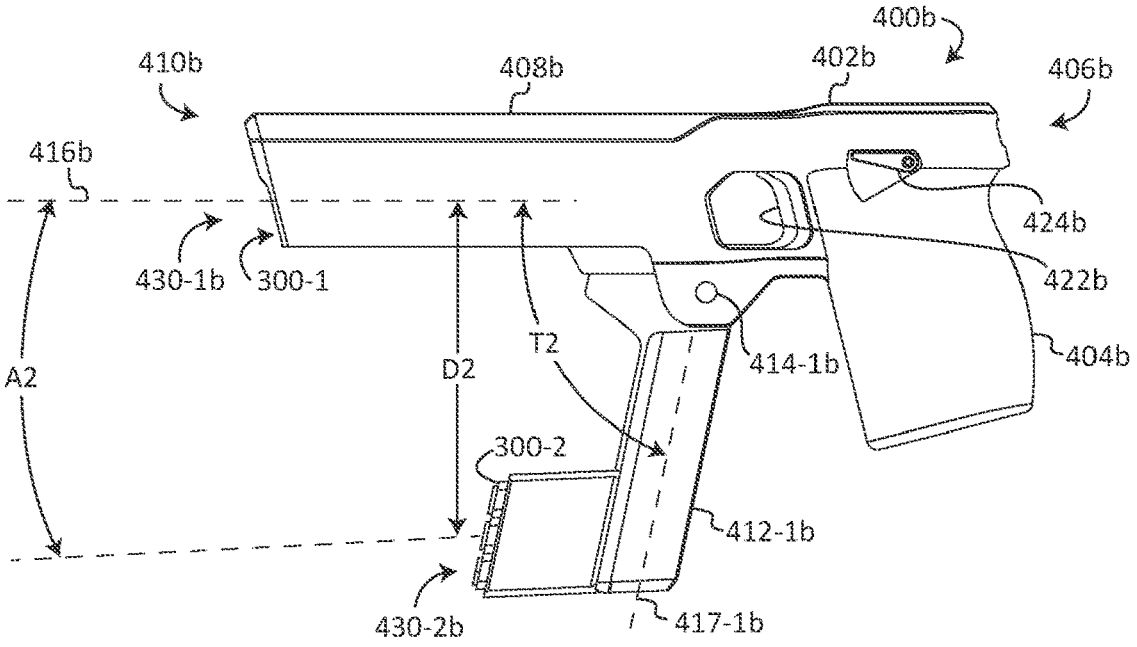
FIG. 4B illustrates another implementation of an actuatable bay conducted electrical weapon in an expanded state, in accordance with various embodiments disclosed herein.
Figure 4C:
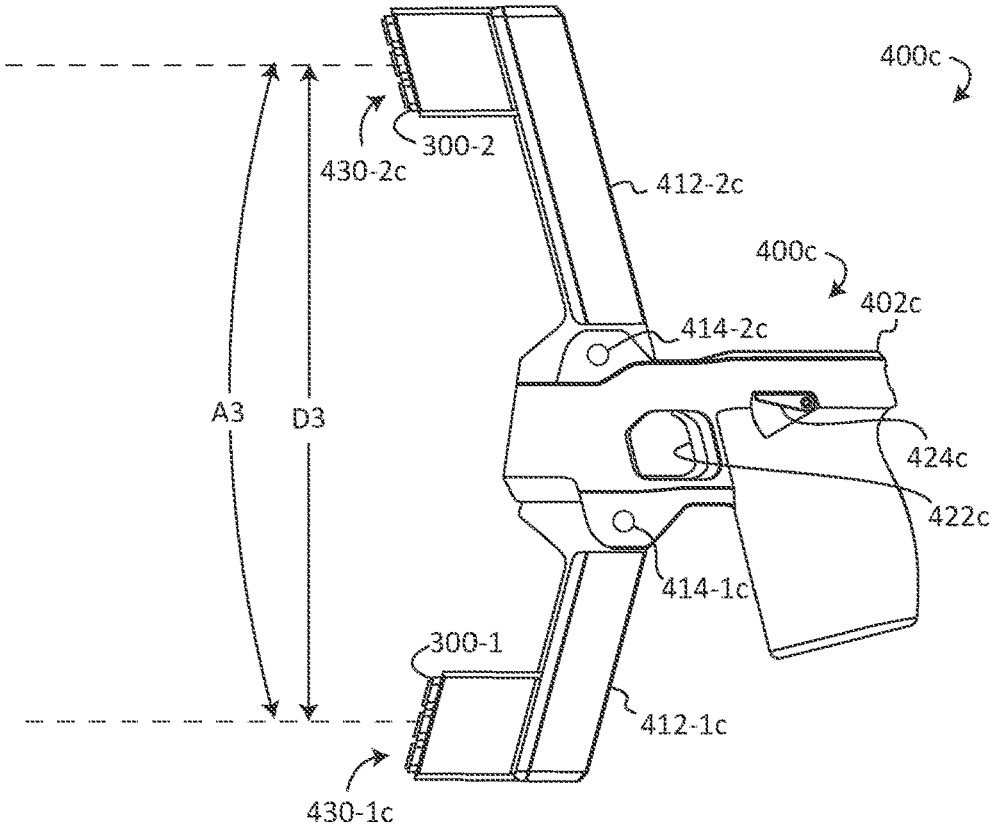
FIG. 4C illustrates another implementation of an actuatable bay conducted electrical weapon in an expanded state, in accordance with various embodiments disclosed herein.

In the example embodiment illustrated in FIG. 4C, CEW 400*c* includes two moveable members, a first moveable member 412-1*c* and a second moveable member 412-2*c*. Each movable member 412-1*c* and 412-2*c* may articulate between a collapsed state and an expanded state. First moveable member 412-1*c* may comprise a first bay 430-1*c*. Second moveable member 412-2*c* may comprise a second bay 430-2*c*. In various embodiments, first moveable member 412-1*c* may move about a first kinematic joint 414-1*c* and second moveable member 412-2*c* may move about a second kinematic joint 414-2*c*. First kinematic joint 414-1*c* and second kinematic joint 414-2*c* may comprise the same kinematic joint, such that first moveable member 414-1*c* and second moveable member 414-2*c* may share a same axis of rotation. In various embodiments, first kinematic joint 414-1*c* and second kinematic joint 414-2*c* may be separate kinematic joints, such that first moveable member 412-1*c* and second moveable member 412-2*c* rotate about independent axes of rotation.

First moveable member 412-1*c* and second moveable member 412-2*c* may be independently actuated via activation of one or more control interfaces, such as trigger 422*c* and or safety 424*c*. CEW 400*c* may have multiple expanded states. For example, a first activation may cause only the first moveable member to transition from a collapsed position to an expanded position in a first expanded state. A second activation may cause the second movable member to transition from a collapsed position to an expanded position in a second expanded state. Because both first moveable member 412-1*c* and second moveable member 412-1*c* may actuate between collapsed and expanded states, CEW 400*c* may occupy a smaller footprint than a CEW comprising a single movable member, such as CEW 100, 400*a* and/CEW 400*b* for a given initial spread, D3. For example, CEW 400*c* may occupy a smaller volume in a collapsed state compared to CEW 400*a* and/or CEW 400*b* due to the collapsible nature of first moveable member 412-1*c* and second moveable member 412-2*c*. An angle between the trajectories of electrodes launched from first bay 430-1*c* and second bay 430-2*c*, such as angle A3, may be a relatively small angle (e.g. less than 5 degrees). In various embodiments, angle A3 may preferably be zero degrees, since a large initial spread may be provided by actuation of both first moveable member 412-1*c* and second moveable member 412-2*c*.

In various embodiments, a CEW may include more than two actuatable bays. For example, a CEW, such as CEW 400*d*, may comprise three actuatable bays. CEW 400*d* may comprise a body 402*d* that extends between a first end 406*d* and a second end 410*d*. CEW 400*d* may comprise three moveable members: a first moveable member 412-1*d*, a second moveable member 412-2*d*, and a third moveable member 412-3*d*. First moveable member 412-1*d* may extend from a first linkage end to a first deployment end opposite the first linkage end. First movable member 412-1*d* may comprise a first bay 430-1*d* disposed at the first deployment end. First movable member 412-1*d* may comprise a first kinematic joint 414-1*d* disposed at the first linkage end that movably couples first movable member 408*d* to body 402*d*. Second moveable member 412-2*d* may extend from a second linkage end to a second deployment end opposite the second linkage end. Second movable member 412-2*d* may comprise a second bay 430-2*d* disposed at the second deployment end. Second movable member may comprise a second kinematic joint 414-2*d* disposed at the second linkage end that movably couples second movable member 412-2*d* to body 402*d*. Third moveable member 412-3*d* may extend from a third linkage end to a third deployment end. Third moveable member 412-3*d* may comprise a third bay 430-3*d* disposed at the third deployment end. Third movable member 412-3*d* may comprise a third kinematic joint 414-3*d* at the third linkage end that movably couples third movable member 413*d* to body 402*d*.

Moveable members 412-1*d*/412-2*d*/412-3*d* may be of equal length, a subset of moveable members 412-1*d*/412-2*d*/412-3*d* may be of equal length, or all of movable members 412-1*d*/412-2*d*/412-3*d* may differ in length. For example, all moveable members 412-1*d*/412-2*d*/412-3*d* may be equal in length such that in a collapsed state, all bays 430-1*d*/430-2*d*/430-3*d* are equally distanced between first end 406*d* and second end 410*d* of CEW 400*d*. As another example, first moveable member 412-1*d* may comprise a length that is longer than a length of second moveable member 412-2*d*, and second moveable member 412-2*d* may comprise a length that is longer than a length of third moveable member 412-3*d*, such that in a collapsed state, first bay 430-1*d* is positioned closest to second end 410*d*, third bay 430-3*d* is positioned closest to first end 406*d*, and second bay 430-2*d* is positioned between first bay 430-1*d* and third bay 430-3*d*.

In various embodiments, each moveable member 412-1*d*/412-2*d*/412-3*d* may rotate about respective kinematic joint (e.g., first kinematic joint 414-1*d*, second kinematic joint 414-2*d*, third kinematic joint 414-3*d*, etc.). In various embodiments, first moveable member 412-1*d*, second moveable member 412-2*d*, and third moveable member 412-3*d* may each be actuated via activation of a control interface, such as trigger 422*d* and/or safety 424*d*. CEW 400*d* may have multiple expanded states. As an example, a first activation may actuate first moveable member 412-1*d* from a collapsed position to an expanded position, and a second activation may actuate both second movable member 412-2*d* and third movable member 412-3*d* from a collapsed position to an expanded position. As another example, movable members 412-1*d*/412-2*d*/412-3*d* may all transition from the collapsed state to the expanded state via a single (e.g., same) activation.

Figure 4D:
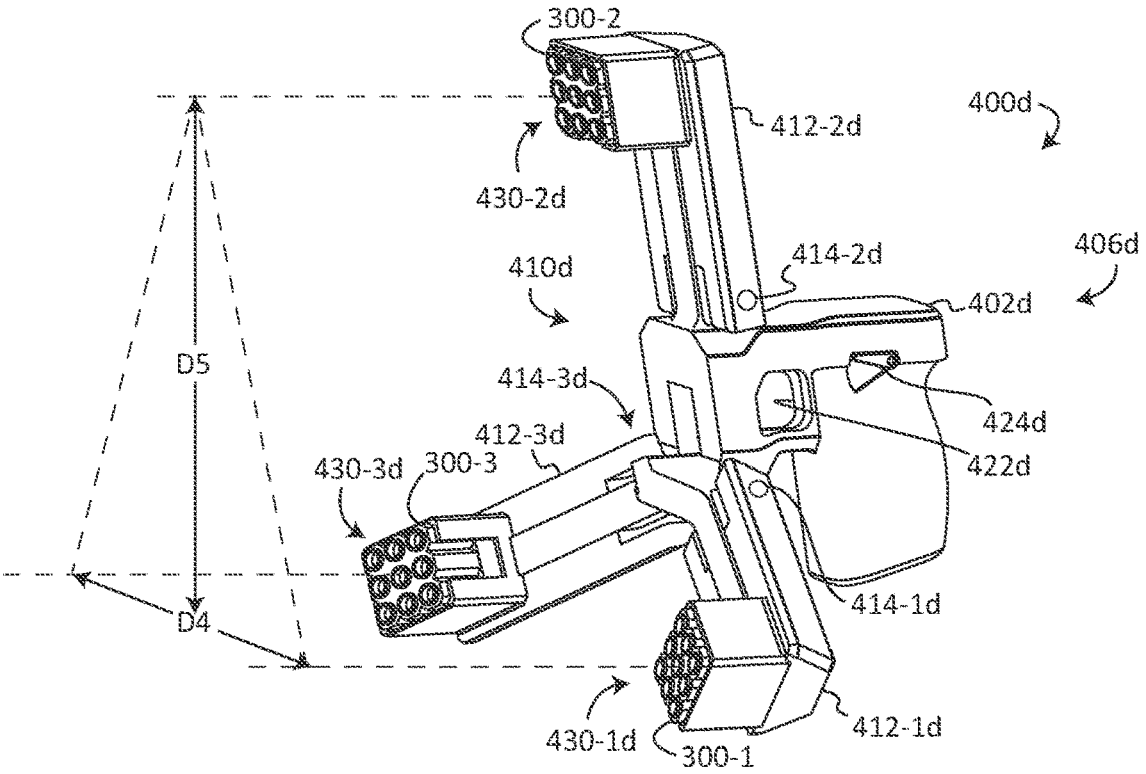
FIG. 4D illustrates another implementation of an actuatable bay conducted electrical weapon in an expanded state, in accordance with various embodiments disclosed herein.

In a fully expanded state, as illustrated in FIG. 4D, first bay 430-1*d* may be a vertical distance D5 apart from second bay 430-2*d* and third bay 430-3*d*. Second bay 430-2*d* and third bay 430-3*d* may be a horizontal distance D4 apart. D4 may be less than D5 such that electrodes launched from second bay 430-2*d* and third bay 430-3*d* traveling toward a standing human target will have a high likelihood of striking the target. The aspect ratio of D5 to D4 may be comparable to the aspect ratio of a typical human. For example, the aspect ratio of D5 to D4 may be 3.5:1, 4:1, or 4.5:1. Accordingly, in various embodiments, D5 may be twelve inches (30.5 centimeters) and D4 may be 3 inches (7.6 centimeters). Launching for example, an electrode from each of first bay 430-1*d*, second bay 430-2*d*, and third bay 430-3*d* via substantially parallel trajectories with a vertical spread D5 of 12 inches and a horizontal spread D4 of 3 inches may have a high likelihood of striking a target and causing NMI.

In various embodiments, kinematic joints such as kinematic joints 114-1, 414-1*a*, 414-1*b*, 414-1*c*, 414-2*c*, 414-1*d*, 414-2*d*, and/or 414-3*d* may restrict movement of movable members from a collapsed state to an expanded state to one degree of freedom. For example, in various embodiments, kinematic joints may restrict movement to strictly translation in one direction, such as a prismatic joint (e.g., telescoping joint) as previously discussed herein. In various embodiments, kinematic joints 114-1, 414-1*a*, 414-1*b*, 414-1*c*, 414-2*c*, 414-1*d*, 414-2*d*, and/or 414-3*d* may include one or more prismatic joints, revolute joints, or combination thereof, enabling respective moveable members to actuate between multiple expanded states and collapsed states. Employing kinematic joints to actuate one or more bays of a conducted electrical weapon may enable a greater initial spread between electrodes launched from the CEW. A greater initial spread may enable electrodes to be launched on substantially parallel, or near parallel trajectories, thereby reducing or eliminating divergence between electrodes. Reducing or eliminating divergence between electrodes as they travel toward a target may increase an effective range of a CEW, without the need for using range-specific cartridges.

In addition to the remote delivery methods via an actuatable bay CEW described above, an actuatable bay CEW may also locally deliver a stimulus signal to a target. As discussed previously herein, delivery of a stimulus signal via terminals positioned on the front face of the CEW may be referred to as a local stun (e.g., drive stun). In various embodiments, each bay of an actuatable bay CEW may comprise at least one terminal electrically connected to the signal generator of the CEW. The control interface may include a drive stun selector, wherein upon selecting drive stun via the control interface, the terminals are provided a stimulus signal. In a drive stun mode, no ignition signal may be provided to the deployment units. In various embodiments, the stimulus signal may periodically alternate polarity between terminals. A drive stun mode may be selected when an actuatable bay CEW is in an expanded state and/or collapsed state. Delivering a local stun to a target while the actuatable bay CEW is in an expanded state may increase the likelihood of causing NMI in a target due to the large initial spread between terminals. Locally delivering a stimulus signal via terminals positioned on the bays of an actuatable bay CEW in an expanded state may increase a likelihood of causing NMI in a target.

Aspects of this disclosure relate to an actuatable bay conducted electrical weapon. In a first example embodiment, a first actuatable bay conducted electrical weapon may comprise: a body extending between a first end and a second end opposite the first end where the body may comprise a handle portion at the first end that is configured to be grasped by a hand of a user; a control interface; one or more kinematic joints, each kinematic joint of the one or more kinematic joints may comprise a respective axis of movement; and a plurality of members, each member of the plurality of members may comprise a bay configured to releasably receive a plurality of electrodes, where at least one member of the plurality of members may be coupled to the body of the conducted electrical weapon via a respective kinematic joint of the one or more kinematic joints, where: in response to a first activation of the control interface, the at least one member of the plurality of members may be configured to move about the respective axis of movement defined by the respective kinematic joint of the one or more kinematic joints by which the at least one member is coupled to the body of the conducted electrical weapon.

In a second example embodiment, an actuatable bay conducted electrical weapon may comprise the first actuatable bay conducted electrical weapon according to the preceding embodiment, where each kinematic joint of the one or more kinematic joints comprises a revolute joint.

In a third example embodiment, an actuatable bay conducted electrical weapon may comprise the first actuatable bay conducted electrical weapon according to any of the preceding embodiments where each kinematic joint of the one or more kinematic joints comprises a prismatic joint.

In a fourth example embodiment, an actuatable bay conducted electrical weapon may comprise the first actuatable bay conducted electrical weapon according to any of the preceding embodiments where the control interface comprises one of a safety and a trigger.

In a fifth example embodiment, an actuatable bay conducted electrical weapon may comprise the first actuatable bay conducted electrical weapon according to any of the preceding embodiments where the plurality of members comprises a fixed member that is not coupled to the body of the conducted electrical weapon via the respective kinematic joint of the one or more kinematic joints.

In a sixth example embodiment, an actuatable bay conducted electrical weapon may comprise the first actuatable bay conducted electrical weapon according to any of the preceding embodiments where in response to one of a manual restorative input and a second activation of the control interface, the at least one member of the plurality of members is configured to move about the respective axis of movement defined by the respective kinematic joint of the one or more kinematic joints by which the at least one member is coupled to the body of the conducted electrical weapon to obstruct deployment of at least one bay.

In a seventh example embodiment, an actuatable bay conducted electrical weapon may comprise the first actuatable bay conducted electrical weapon according to any of the preceding embodiments where the plurality of members consists of a first member and a second member, the first member coupled to a first kinematic joint of the one or more kinematic joints, and the second member coupled to a second kinematic joint of the one or more kinematic joints, where: in response to the first activation of the control interface, the first member is configured to move about a first axis of movement defined by the first kinematic joint of the one or more kinematic joints; and in response to a second activation of the control interface, the second member is configured to move about a second axis of movement defined by the second kinematic joint of the one or more kinematic joints.

In an eighth example embodiment, an actuatable bay conducted electrical weapon may comprise the first actuatable bay conducted electrical weapon according to the seventh example embodiment where the first axis of movement and the second axis of movement comprise a same axis of movement.

In a ninth example embodiment, an actuatable bay conducted electrical weapon may comprise the first actuatable bay conducted electrical weapon according to the seventh example embodiment where the first kinematic joint and the second kinematic joint each comprise a revolute joint.

In a tenth example embodiment, an actuatable bay conducted electrical weapon may comprise the first actuatable bay conducted electrical weapon of the seventh example embodiment where the first activation of the control interface and the second activation of the control interface comprise a same activation.

In an eleventh example embodiment, a second actuatable bay conducted electrical weapon may comprise: a body comprising a first end and a second end opposite the first end, the body comprising a handle portion at the first end configured to be grasped by a hand of a user; a control interface; a fixed member extending between the first end to the second end, the fixed member comprising a first bay proximate the second end, the first bay configured to releasably receive a first plurality of electrodes; a kinematic joint positioned between the handle portion and the second end of the conducted electrical weapon; and a moveable member coupled to and extending from the kinematic joint, the movable member comprising a second bay configured to releasably receive a second plurality of electrodes; where: the second bay is selectively positioned a first distance from the first bay of the fixed member; and in response to an activation of the control interface, the second bay of the moveable member is configured to move to a position a second distance from the first bay of the fixed member, the second distance greater than the first distance.

In a twelfth example embodiment, an actuatable bay conducted electrical weapon may comprise the second actuatable bay conducted electrical weapon according to the eleventh example embodiment where the second distance is greater than three inches.

In a thirteenth example embodiment, an actuatable bay conducted electrical weapon may comprise the second actuatable bay conducted electrical weapon according to the eleventh example embodiment where the control interface comprises one of a trigger and a safety.

In a fourteenth example embodiment, an actuatable bay conducted electrical weapon may comprise the second actuatable bay conducted electrical weapon according to the eleventh example embodiment where prior to the activation of the control interface, the second bay is configured to obstruct deployment of the first bay.

In a fifteenth example embodiment, an actuatable bay conducted electrical weapon may comprise the second actuatable bay conducted electrical weapon according to the eleventh example embodiment where the kinematic joint comprises a revolute joint; and in response to an activation of the control interface, the movable member is configured to rotate about an axis of rotation defined by the revolute joint to the position the second distance from the first bay of the fixed member.

In a twelfth example embodiment, an actuatable bay conducted electrical weapon may comprise the second actuatable bay conducted electrical weapon according to the eleventh example embodiment where the second distance is greater than three inches.

In a sixteenth example embodiment, a third actuatable bay conducted electrical weapon may comprise: a handle portion at a first end of the conducted electrical weapon configured to be grasped by a hand of a user, the handle portion comprising a control interface; a fixed member extending from the first end of the conducted electrical weapon to a second end of the conducted electrical weapon along a first axis, the fixed member comprising a first bay configured to releasably receive a first electrode; a joint positioned between the handle portion and the second end of the conducted electrical weapon; and a moveable member coupled and extending from the joint along a second axis, the moveable member comprising a second bay configured to releasably receive a second electrode, where: prior to an activation of the control interface, the moveable member is configured to be provided in a collapsed state in which the second axis of the moveable member forms a first angle relative to the first axis of the fixed member; and in response to the activation of the control interface, the moveable member is configured to rotate from the collapsed state to an expanded state in which the second axis of the moveable member forms a second angle relative to the first axis of the fixed member, the second angle greater than the first angle.

In a seventeenth example embodiment, an actuatable bay conducted electrical weapon may comprise the third actuatable bay conducted electrical weapon according to the sixteenth example embodiment where the first angle is 0 degrees.

In an eighteenth example embodiment, an actuatable bay conducted electrical weapon may comprise the third actuatable bay conducted electrical weapon according to the sixteenth example embodiment where the second angle is less than 90 degrees.

In a nineteenth example embodiment, an actuatable bay conducted electrical weapon may comprise the third actuatable bay conducted electrical weapon according to the sixteenth example embodiment where in the collapsed state the first bay is configured to obstruct the second bay.

In a twentieth example embodiment, an actuatable bay conducted electrical weapon may comprise the third actuatable bay conducted electrical weapon according to the sixteenth example embodiment where a length of the moveable member along the second axis is at least two inches.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a body, the barrel positioned in the body", the barrel is not a claimed element of the apparatus, but an object that cooperates with the "body" of the "apparatus" by being positioned in the "body". A person of ordinary skill in the art will appreciate that this disclosure includes any practical combination of the structures and methods disclosed. While for the sake of clarity of description several specifics embodiments of the invention have been described, the scope of the invention is intended to be measured by the claims as set forth below.

What is claimed is:

1. An actuatable bay conducted electrical weapon comprising:

a body extending between a first end and a second end opposite the first end, the body comprising a handle portion at the first end, the handle portion configured to be grasped by a hand of a user;

a control interface;

one or more kinematic joints, each kinematic joint of the one or more kinematic joints comprising a respective axis of movement; and a plurality of members, each member of the plurality of members comprising a respective bay configured to receive a respective electrode, wherein at least one member of the plurality of members is coupled to the body of the conducted electrical weapon via a respective kinematic joint of the one or more kinematic joints, and wherein:

in response to a first activation of the control interface, the at least one member of the plurality of members is configured to move about the respective axis of movement defined by the respective kinematic joint of the one or more kinematic joints by which the at least one member is coupled to the body of the conducted electrical weapon.

2. The conducted electrical weapon of claim 1 wherein each kinematic joint of the one or more kinematic joints comprises a revolute joint.

3. The conducted electrical weapon of claim 1 wherein each kinematic joint of the one or more kinematic joints comprises a prismatic joint.

4. The conducted electrical weapon of claim 1 wherein the control interface comprises one of a safety and a trigger.

5. The conducted electrical weapon of claim 1 wherein the plurality of members comprises a fixed member that is coupled to the body of the conducted electrical weapon separately from the one or more kinematic joints.

6. The conducted electrical weapon of claim 1 wherein in response to one of a manual restorative input and a second activation of the control interface, the at least one member of the plurality of members is configured to move about the respective axis of movement defined by the respective kinematic joint of the one or more kinematic joints by which the at least one member is coupled to the body of the conducted electrical weapon to obstruct the respective bay of one member of the plurality of members.

7. The conducted electrical weapon of claim 1 wherein the plurality of members comprises a first member and a second member, the first member coupled to a first kinematic joint of the one or more kinematic joints, and the second member coupled to a second kinematic joint of the one or more kinematic joints, wherein:

in response to the first activation of the control interface, the first member is configured to move about a first axis of movement defined by the first kinematic joint of the one or more kinematic joints; and in response to a second activation of the control interface, the second member is configured to move about a second axis of movement defined by the second kinematic joint of the one or more kinematic joints.

8. The conducted electrical weapon of claim 7 wherein the first axis of movement and the second axis of movement comprise a same axis of movement.

9. The conducted electrical weapon of claim 7 wherein the first kinematic joint and the second kinematic joint each comprise a respective revolute joint.

10. The conducted electrical weapon of claim 7 wherein the first activation of the control interface and the second activation of the control interface comprise a same activation.

11. An actuatable bay conducted electrical weapon comprising:

a body comprising a first end and a second end opposite the first end, the body comprising a handle portion at the first end configured to be grasped by a hand of a user;

a control interface;

a fixed member extending between the first end to the second end, the fixed member comprising a first bay proximate the second end, the first bay configured to receive a first plurality of electrodes;

a kinematic joint positioned between the handle portion and the second end of the conducted electrical weapon; and a moveable member coupled to and extending from the kinematic joint, the movable member comprising a second bay configured to releasably receive a second plurality of electrodes; wherein:

the second bay is selectively positioned a first distance from the first bay of the fixed member; and in response to an activation of the control interface, the second bay of the moveable member is configured to move to a position a second distance from the first bay of the fixed member, the second distance greater than the first distance.

12. The conducted electrical weapon of claim 11 wherein the second distance is greater than three inches.

13. The conducted electrical weapon of claim 11 wherein the control interface comprises one of a trigger and a safety.

14. The conducted electrical weapon of claim 11 wherein prior to the activation of the control interface, the second bay is positioned to obstruct the first bay.

15. The conducted electrical weapon of claim 11 wherein:

the kinematic joint comprises a revolute joint; and in response to the activation of the control interface, the movable member is configured to rotate about an axis of rotation defined by the revolute joint to the position the second distance from the first bay of the fixed member.

16. An actuatable bay conducted electrical weapon comprising:

a handle portion at a first end of the conducted electrical weapon configured to be grasped by a hand of a user;

a first member extending from the first end of the conducted electrical weapon to a second end of the conducted electrical weapon along a first axis, the first member configured to engage a first deployment unit;

a joint positioned between the handle portion and the second end of the conducted electrical weapon; and a moveable member coupled and extending from the joint along a second axis, the moveable member configured to engage a second deployment unit, wherein the moveable member is configured to rotate about the joint between:

a collapsed state in which the second axis of the moveable member forms a first angle relative to the first axis of the first member; and an expanded state in which the second axis of the moveable member forms a second angle relative to the first axis of the fixed member, the second angle greater than the first angle.

17. The conducted electrical weapon of claim 16 wherein the first angle is 0 degrees.

18. The conducted electrical weapon of claim 16 wherein the second angle is less than 90 degrees.

19. The conducted electrical weapon of claim 16 wherein in the collapsed state the first bay is configured to obstruct the second bay.

20. The conducted electrical weapon of claim 16 wherein a length of the moveable member along the second axis is at least two inches.

* * * * *